United States Patent [19]

Sawada et al.

[11] 4,237,604

[45] Dec. 9, 1980

[54] APPARATUS FOR PAIRING TWO ROWS OF SLIDE FASTENER COUPLING ELEMENTS

[75] Inventors: Mitsuo Sawada; Toyoo Morita, both of Kurobe, Japan

[73] Assignee: Yoshida Kogyo K. K., Tokyo, Japan

[21] Appl. No.: 34,170

[22] Filed: Apr. 27, 1979

[30] Foreign Application Priority Data

Apr. 28, 1978 [JP] Japan ..... 53-51132

[51] Int. Cl.[3] ..... B23P 19/04

[52] U.S. Cl. ..... 29/766

[58] Field of Search ..... 29/33.2, 408, 410, 766, 29/767, 771, 779, 819

[56] References Cited

U.S. PATENT DOCUMENTS

| | | | |
|---|---|---|---|
| 2,219,165 | 10/1940 | Nedal | 29/408 |
| 2,287,263 | 6/1942 | Nedal | 29/408 |
| 2,613,433 | 10/1952 | Rojahn | 29/766 |
| 3,270,408 | 9/1966 | Nealis | 29/408 |
| 3,955,263 | 5/1976 | Gauthier | 29/766 |

*Primary Examiner*—Ervin M. Combs

*Attorney, Agent, or Firm*—Hill, Van Santen, Steadman, Chiara & Simpson

[57] ABSTRACT

An apparatus for interengaging a pair of rows of slide fastener coupling elements on a pair of stringer tapes, respectively, with a pair of top end stops mounted on the stringer tapes respectively at confronting ends of the rows of coupling elements, includes a base and a pairing guide mounted on the base and normally defining a substantially Y-shaped guide channel including a pair of branched guide passages for receiving disengaged rows of coupling elements, respectively, and a joint passage for discharging interengaged rows of coupling elements. The pairing guide comprises first guide means fixed to the base and including first flange means defining the branched guide passages, and second guide means movably supported on the base and including second flange means normally defining the joint passage. The Y-shaped guide channel is thus normally defined jointly by the first and second flange means. The second flange means is retractable away from the first flange means in response to the engagement of at least one of the top end stops with the second flange means, whereby the top end stops can be discharged out of the pairing guide.

15 Claims, 12 Drawing Figures

APPARATUS FOR PAIRING TWO ROWS OF SLIDE FASTENER COUPLING ELEMENTS

BACKGROUND OF THE INVENTION

1. Field of the Invention

The present invention relates to an apparatus for interengaging or mating a pair of rows of slide fastener coupling elements on a pair of stringer tapes, respectively, with a pair of top end stops mounted on the stringer tapes respectively at confronting ends of the rows of coupling elements.

2. Prior Art:

To manufacture a pair of elongate slide fastener stringers having top end stops, it has been customary to attach rows of coupling elements to a pair of stringer tapes along their opposed edges, then pair the rows of coupling elements into a chain of coupling elements, and finally affix top end stops to the stringer tapes at confronting ends of the coupling element rows. For the purposes of saving cost and time, there has been a need for a machine that can produce such slide fastener stringers in two steps, i.e., attaching coupling elements and top end stops simultaneously to a pair of stringer tapes, and interengaging the coupling element rows. Although the former step could be performed relatively easily, the latter step has been considered almost impossible to accomplish since the top end stops are so sized that they are not able to pass through the exit end of a substantially Y-shaped guide channel designed solely to bring the rows of coupling elements into mutual interengagement.

SUMMARY OF THE INVENTION

According to the present invention, a pairing guide having a substantially Y-shaped guide channel for mating two rows of coupling elements together comprises first guide means fixedly supported on a base and including first flange means defining a pair of branched passages of the guide channel, and second guide means movably supported on the base and including second flange means normally defining a joint passage into which the branched passages merge, the Y-shaped guide channel being normally defined jointly by the first and second guide means. The second guide means is moved away from the first guide means in response to the engagement of at least one of the top end stops with the second flange means, whereby the top end stops can be discharged out of the pairing guide.

It is an object of the present invention to provide an apparatus for interengaging a pair of rows of coupling elements with opposed top end stops disposed respectively at confronting ends of the coupling element rows.

Another object of the present invention is to provide a coupling-elements pairing apparatus that allows a pair of mated slide fastener stringer with top end stops to be produced at a greater rate and a lower cost.

Many other advantages, features and additional objects of the present invention will become manifest to those versed in the art upon making reference to the detailed description and the accompanying drawings in which preferred embodiments incorporating the principles of the present invention are shown by way of illustrative example.

DETAILED DESCRIPTION

Figure 1:
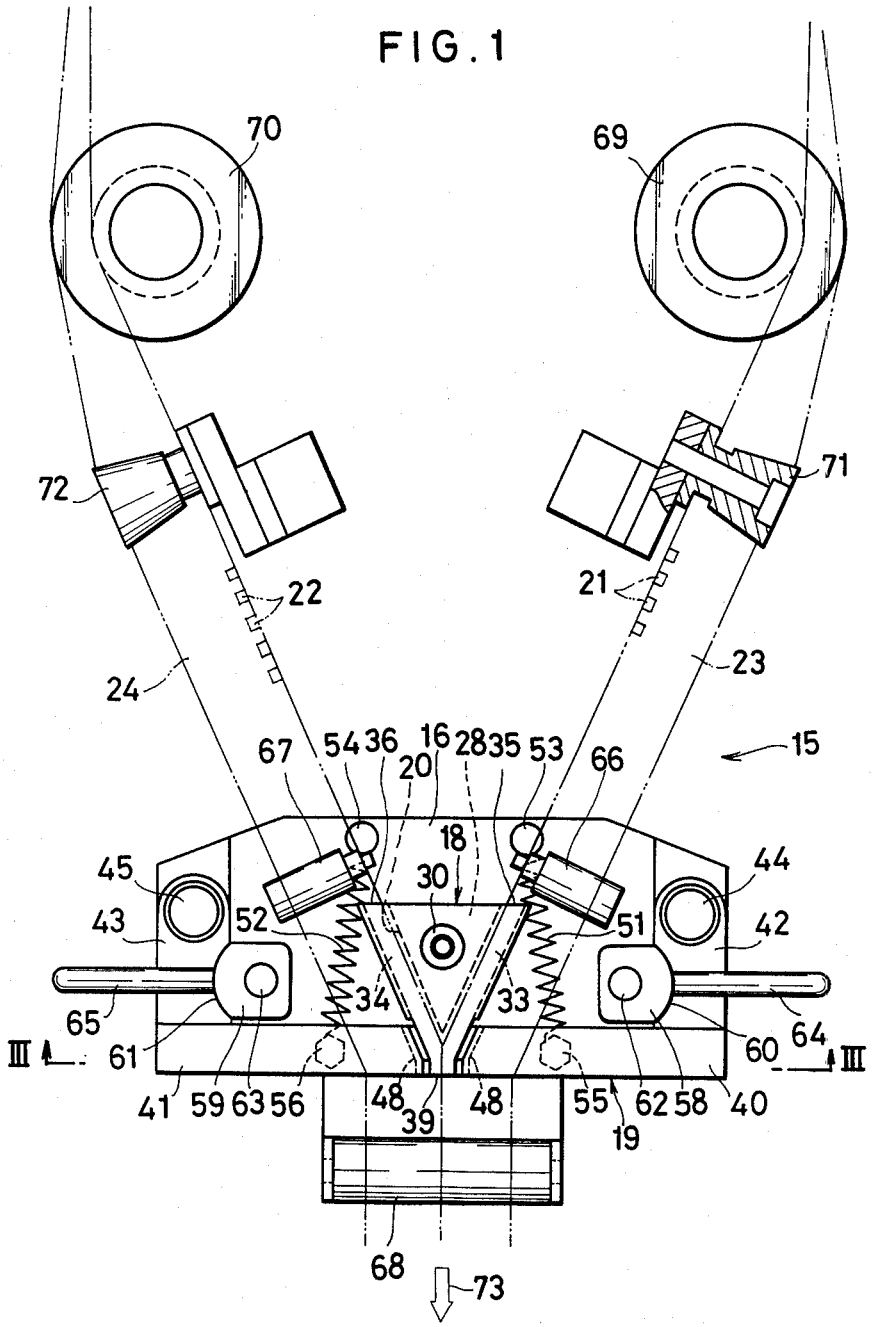
FIG. 1 is a plan view of a pairing apparatus constructed in accordance with the present invention.
Figure 2:
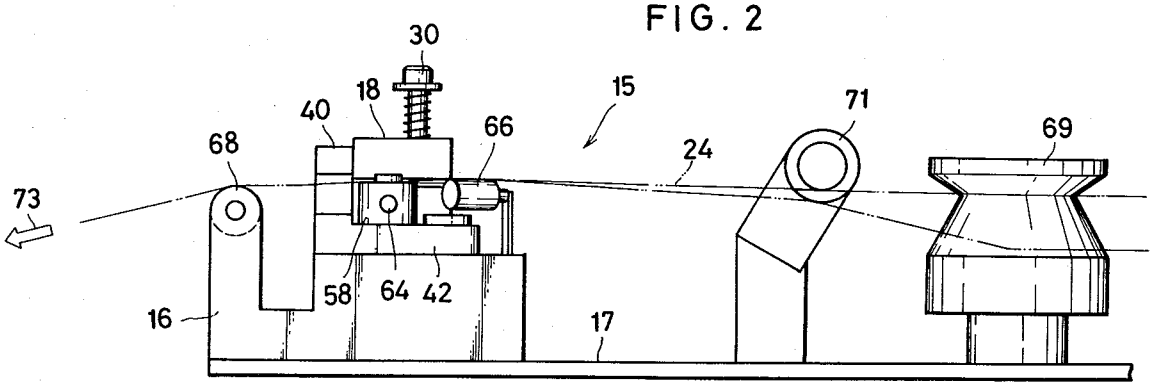
FIG. 2 is a side elevational view of the pairing apparatus of FIG. 1.
Figure 3:
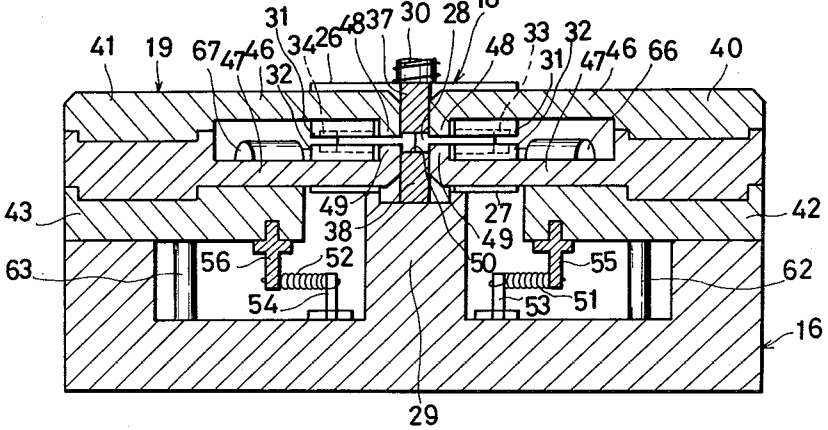
FIG. 3 is a cross-sectional view taken along line III—III of FIG. 1.

The principles of the present invention are particularly useful when embodied in a pairing apparatus such as shown in FIGS. 1, 2 and 3 generally indicated by the numeral 15.

The pairing apparatus 15 generally comprises a base 16 mounted on a support frame 17 (FIG. 2), and a pairing guide including first guide means 18 fixed to the base 16 and second guide means 19 movably supported on the base 16. The pairing guide normally defines therein a substantially Y-shaped guide channel 20 for the passage therethrough of a pair of rows of slide fastener coupling elements 21,22 mounted on opposed longitudinal edges of a pair of stringer tapes 23,24, respectively. A pair of top end stops 13,14 (FIGS. 4 and 5) are mounted on the stringer tapes 23,24 respectively at confronting ends of the rows of coupling elements 21,22.

As better shown in FIG. 3, the first guide means 18 comprises a pair of upper and lower triangular plates 26,27 vertically spaced from each other and interconnected by a triangular central neck 28 disposed therebetween, the upper and lower plates 26,27 being supported on a rest 29 by means of a bolt 30. The upper and lower plates 26,27 include two pairs of spaced side flanges 31,32 projecting from edges of the plates 26,27, respectively, toward each other and located one pair on each side of the central neck 28. The side flanges 31,32 extend from a pair of inlet openings 35,36 (FIG. 1) of the Y-shaped guide channel 30 and define a pair of branch guide passages 33,34 of the guide channel 30 one on each side of the central neck 28 for receiving disengaged rows of coupling elements 21,22, respectively. The upper and lower plates 26,27 include a pair of extensions or nose portions 37,38, respectively, located at the apex of the triangular shape of the plates 26,27. The Y-shaped guide channel 20 includes a joint passage 50 into which the branched guide passages 33,34 merge, the joint passage 50 having an outlet opening 39 (FIG. 1) remote from the inlet openings 35,36 and disposed at the nose portions 37,38 for discharging interengaged rows of coupling elements 21,22. The side flanges 31,32 terminate short of the joint passage 50 so that the nose portions 37,38 are free of any side flanges.

The second guide means 19 comprises a pair of L-shaped arm means 40,41 secured respectively to a pair of limbs 42,43 pivotally mounted on the base 16 by means of a pair of pins 44,45 (FIG. 1), respectively, the pair of arm means 40,41 being located one on each side of the first guide means 18 and pivotally movable toward and away from the first guide means 18. Each arm means 40,41 includes a pair of arms 46,47 (FIG. 3) vertically spaced from each other and having a pair of spaced side flanges 48,49 mounted on their distal ends and extending toward each other, the side flanges 48,49 jointly normally defining a portion of the joint passage 50. When the arms 40,41 are held in engagement with the upper and lower plates 26,27 of the first guide means 18, the side flanges 48,49 on the arms 46,47 and the nose portions 37,38 of the plates 26,27 jointly provide the joint passage 50. A pair of tension springs 51,52 act between a pin 53 on the base 16 and a pin 55 on the limb 42 and between a pin 54 on the base 16 and a pin 56 on the limb 43, respectively, and normally urge the arm means 40,41 in a direction to cause the side flanges 48,49 to engage the nose portions 37,38 to complete the Y-shaped guide channel 20.

Located adjacent to the pair of arm means 40,41 are a pair of eccentric cams 58,59, respectively, having a pair of respective arcuate cam surfaces 60,61 and angularly movably supported on the base 16 by means of a pair of pins 62,63, there being a pair of levers 64,65 attached to the cams 58,59, respectively. When the cams 58,59 are angularly moved about the pins 62,63, respectively, by manipulation of the levers 64,65 in a direction to cause the cam surfaces 60,61 to slidably engage the arm means 40,41, respectively, the side flanges 48,49 are displaced away from the nose portions 37,38. Such movement of the arm means 40,41 due to the camming action facilitates initial coupling of the two rows of coupling elements 21,22 between the nose portions 37,38 of the plates 26,27.

A pair of horizontal guide rollers 66,67 are rotatably mounted on the base 16 and positioned adjacent to the inlet openings 35,36 for guiding the stringer tapes 23,24 so that the rows of coupling elements 21,22 are directed into the passages 33,34 in the first guide means 18 through the inlet openings 35,36. A pair of vertical rollers 69,70 are rotatably mounted on the support frame 17 and a pair of horizontal roller 71,72 are rotatably mounted on the support frame 17 and located adjacent to the vertical rollers 69,70, respectively. The vertical rollers 69,70 and horizontal rollers 71,72 jointly support the stringer tapes 23,24 thereon so as to lie in a horizontal plane as they move over the guide rollers 66,67. A roller 68 is rotatably supported on the base 16 and is positioned downstream of the first guide means 18 for supporting the stringer tapes 23,24 with the rows of coupling elements 21,22 interengaged as they issue out of the outlet opening 49.

Figure 4:
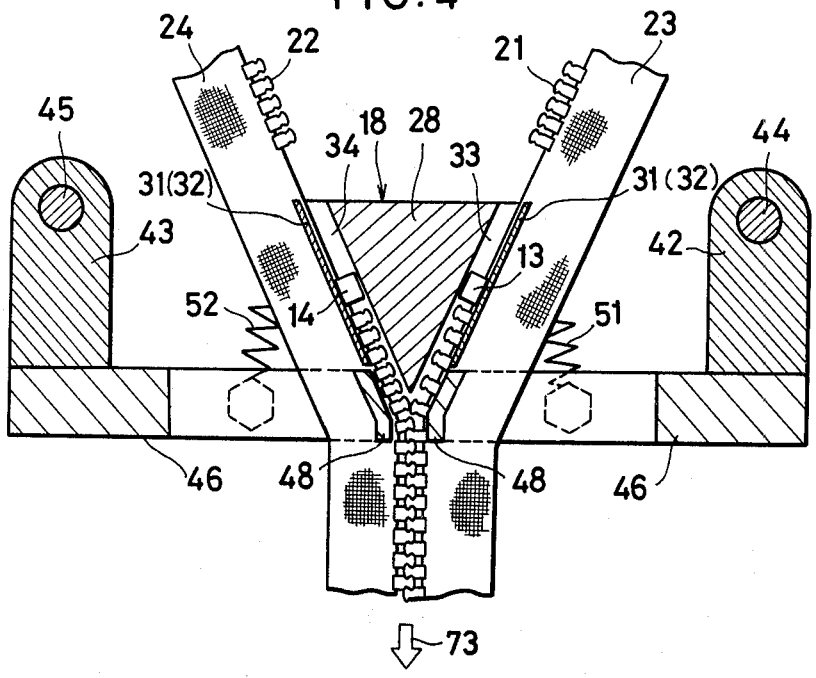
FIG. 4 is a horizontal cross-sectional view of the central parts of the apparatus in a position before actuation a of second guide means.
Figure 5:
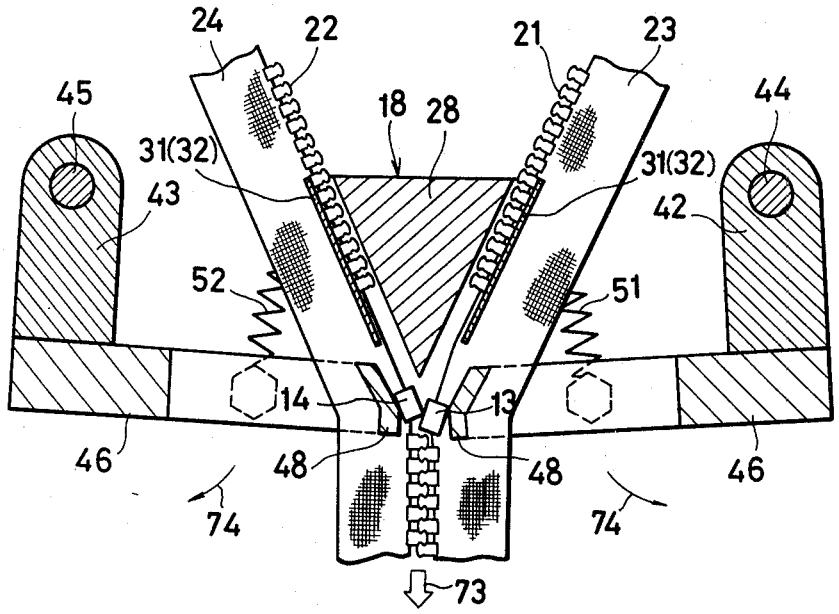
FIG. 5 is a view similar to FIG. 4, showing the position of the parts after the second guide means has been retracted.
Figure 6:
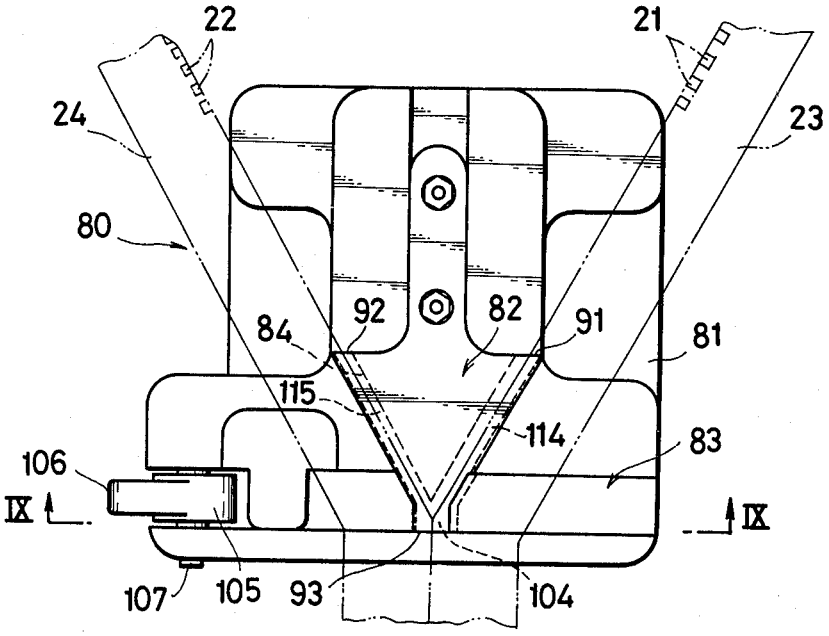
FIG. 6 is a plan view of a pairing apparatus according to a second embodiment of the present invention.

In operation, the rows of coupling elements 21,22 progress through the guide passages 33,34, respectively, and are meshed or interengaged into a coupling element chain at the exit passage 50, whereupon the interengaged rows of coupling elements 21,22 are discharged out of the outlet opening 39 in the direction of the arrow 73, as shown in FIG. 4. At this time, the stringer tapes 23,24 move along between the spaced side flanges 31,32 of the upper and lower plates 26,27 and then between the spaced side flanges 48,49 on the arm means 40,41. When the top end stops 13,14 arrive at the exit passage 50, they abut against each other and engage the side flanges 48,49 (FIG. 5) since the top end stops 13,14 as they are held together cannot pass through the exit passage 50. Continued advancing movement of the interengaged rows of coupling elements 21,22 in the direction of the arrow 73 causes the top end stops 13,14 to force the arm means 40,41 to pivot about the pins 44,45 in the directions of the arrows 74,74, respectively, against the bias of the springs 51,52. Thus, the side flanges 48,49 are driven away from the nose portions 37,38 and side flanges 31,32 of the first guide means 18 and are moved away from each other, thereby allowing the top end stop 13,14 to move past the side flanges 48,49. Upon passage of the top end stops 13,14 beyond the side flanges 48,49, the arm means 40,41 are reinstated under the force from the springs 51,52 to their original position in which the side flanges 48,49 engage the nose portions 37,38, and they jointly restore the exit passage 50 of the Y-shaped guide channel 20. Accordingly, with this arrangement, the rows of coupling elements 21,22 can be interengaged progressively by the pairing guide while the top end stops 13,14 can pass unobstructedly through the pairing guide.

Figure 7:
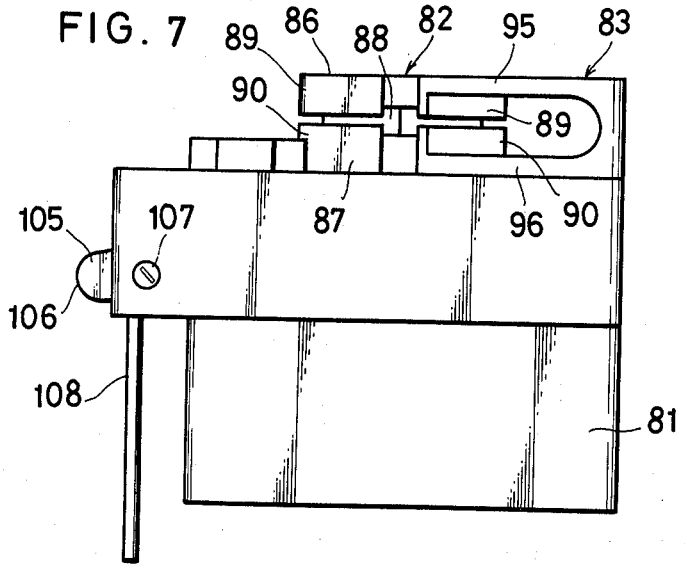
FIG. 7 is a front elevational view of the pairing apparatus shown in FIG. 6.
Figure 8:
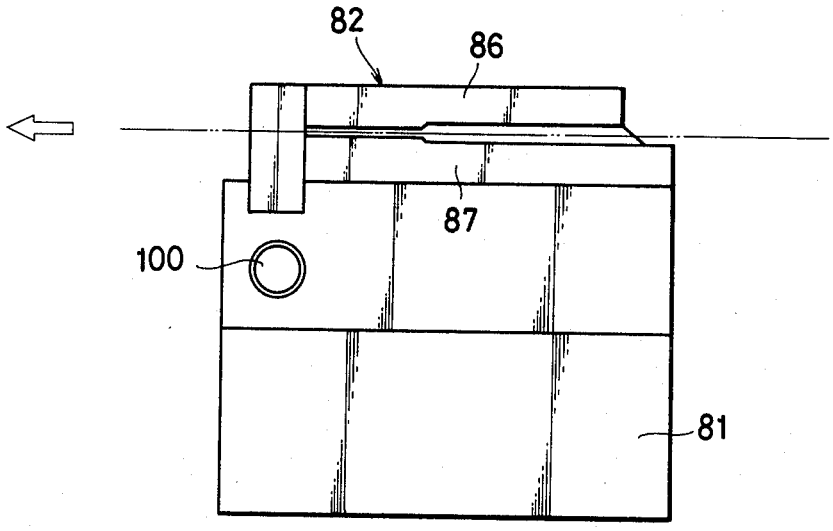
FIG. 8 is a side elevational view of the pairing apparatus of FIG. 6.
Figure 9:
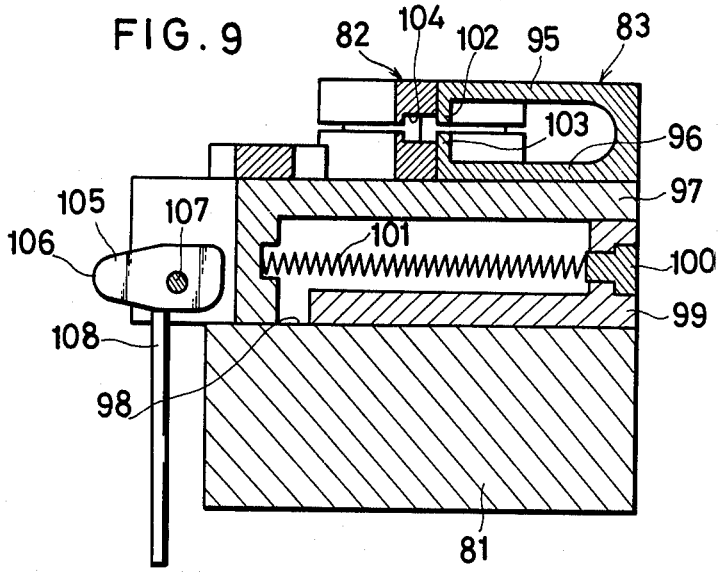
FIG. 9 is a cross-sectional view taken along line IX—IX of FIG. 6.
Figure 10:
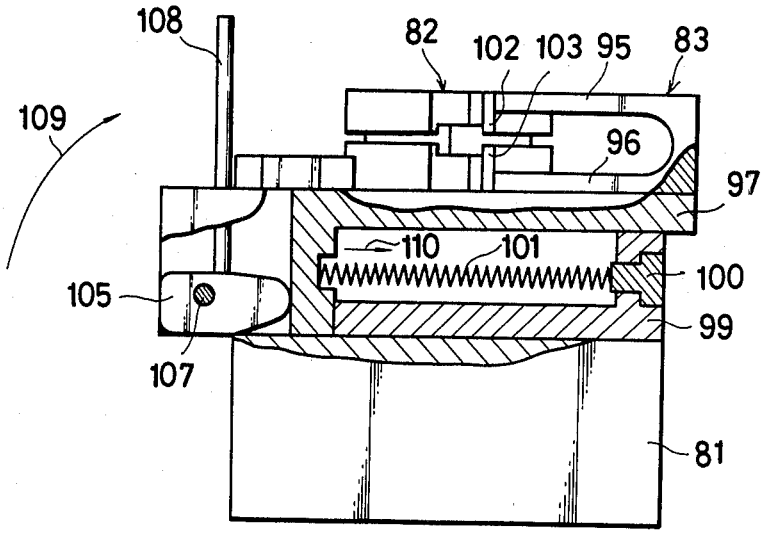
FIG. 10 is a view similar to FIG. 9 illustrating the position of the parts in which a lever for retracting a second guide means is actuated.

According to a second embodiment shown in FIGS. 6 through 12, a pairing apparatus 80 generally comprises a base 81 and a pairing guide including first guide means 82 fixedly mounted on the base 81 and second guide means 83 movably mounted on the base 81, the pairing guide normally providing therein a substantially Y-shaped guide channel 84 for the rows of coupling elements 21,22 to pass therethrough. As best shown in FIG. 7, the first guide means 82 comprises a pair of spaced upper and lower plates 86,87 interconnected by a central triangular neck 88. The upper and lower plates 86,87 include two pairs of spaced side flanges 89,90 projecting from edges of the plates 86,87, respectively, toward each other and located one pair on each side of the central neck 88. The side flanges 89,90 define a pair of branched guide passages 114,115 of the Y-shaped guide channel 84, having a pair of inlet openings 91,92, respectively. The Y-shaped guide channel 84 includes a joint passage 104 having an outlet opening 93 located remotely from the inlet openings 91,92. One pair of the side flanges 89,90 extends from the inlet opening 92 all the way to the outlet opening 93, and the other pair of the side flanges 89,90 extending from the inlet opening 91 terminates short of the joint passage 104.

The second guide means 83 (FIG. 9) includes a pair of spaced upper and lower arms 95,96 mounted on a slide 97 transversely slidable in a horizontal recess 98 in the base 81. A stop 99 is fixedly disposed in the recess 98 and has a plug 100, there being a compression coil spring 101 acting between the slide 97 and the plug 100. The upper and lower arms 95,96 have on their distal ends a pair of spaced upper and lower side flanges 102,103, respectively, which are normally urged under the resiliency of the spring 101 against the end portions of the upper and lower plates 86,87 which are located adjacent to the joint passage 104 and are free of side flanges.

An eccentric cam 105 having a cam surface 106 is angularly movably mounted on the base 81 by means of a pin 107 and is pivotable by the manipulation of a lever 108 attached to the cam 105. When the cam 105 is angularly moved from the position of FIG. 9 to that of FIG. 10 in the direction of the arrow 109, the slide 97 is slid in the direction of the arrow 110 against the bias of the spring 101, whereupon the side flanges 102,103 are displaced away from the upper and lower plates 86,87 in a direction normal to the rows of coupling elements 21,22.

Figure 11:
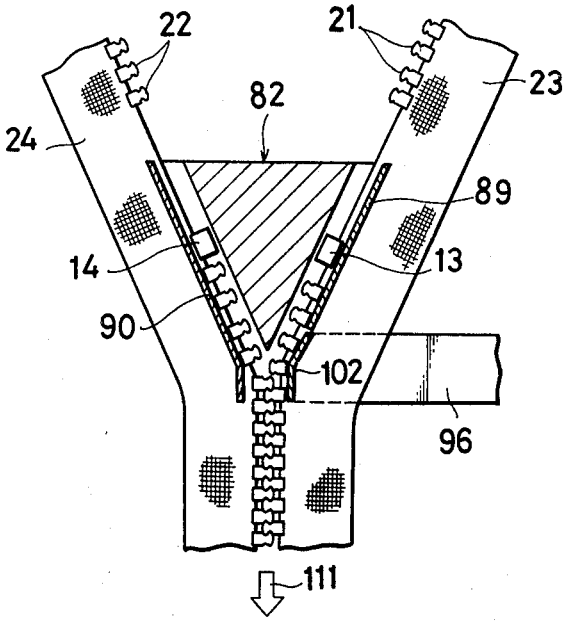
FIG. 11 is a horizontal cross-sectional view of the central parts of the apparatus of FIG. 6, the parts being in a position before the second guide means is actuated.
Figure 12:
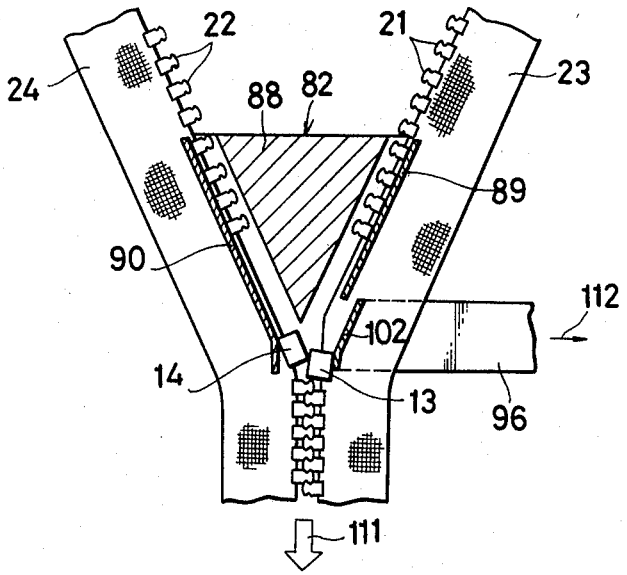
FIG. 12 is a view similar to FIG. 11, showing the parts position upon retraction of the second guide means.

The rows of coupling elements 21,22 are progressively meshed together while they are moving in the direction of the arrow 111 through the exit passage 104 completed by the spring-loaded side flanges 102,103 (FIG. 11). When the top end stops 13,14 arrive at the exit passage 104, one of the end stops 13 engages the side flanges 102,103 and pushes the arms 95,96 sideways in the direction of the arrow 112, as illustrated in FIG. 12. As soon as the top end stops 13,14 move past the side flanges 102,103 and are discharged out of the outlet opening 93, the arms 95,96 are returned in response to the bias of the spring 101 to cause the side flanges 102,103 to re-engage the upper and lower plates 86,87, respectively.

Although various minor modifications may be suggested by those versed in the art, it should be understood that we wish to embody within the scope of the patent warranted hereon, all such embodiments as reasonably and properly come within the scope of our contribution to the art.

We claim:

1. An apparatus for interengaging a pair of rows of slide fastener coupling elements on a pair of stringer tapes, respectively, with a pair of top end stops mounted on the stringer tapes respectively at confronting ends of the rows of coupling elements, comprising:

(a) a base; and (b) a pairing guide mounted on said base and normally defining a substantially Y-shaped guide channel including a pair of branched passages for receiving disengaged rows of coupling elements, respectively, said branched passages being joined together into a joint passage for discharging interengaged rows of coupling elements, said pairing guide comprising:

(1) first guide means fixed to said base and including first flange means defining said branched passages; and (2) second guide means movably supported on said base and including second flange means normally defining a portion of said joint passage, said second flange means being movable away from said first flange means in response to the engagement of at least one of the top end stops with said second flange means, whereby the top end stops can be discharged out of said pairing guide.

2. An apparatus according to claim 1, said first guide means comprising a pair of spaced plates and a central neck disposed between and interconnecting said spaced plates, said first flange means comprising a pair of spaced side flanges projecting from said plates, respectively, toward each other and located on each side of said central neck, each of the stringer tapes being movable between said spaced side flanges when the rows of coupling elements pass through said Y-shaped guide channel.

3. An apparatus according to claim 2, said side flanges terminating short of said joint passage whereby said spaced plates include a pair of side-flange-free end portions, respectively, located at said joint passage, and said second side flange means normally engaging said side-flange-free end portions to complete said Y-shaped guide channel.

4. An apparatus according to claim 2, one of said side flanges terminating short of said joint passage whereby said plates include a pair of end portions free of side flanges at their one side and located at said joint passage, and said second side flange means normally engaging said end portions at said one side for completing said Y-shaped guide channel.

5. An apparatus according to claim 1, said second guide means comprising a pair of arm means pivotally mounted on said base and located one on each side of said first guide means, said second flange means comprising a pair of spaced side flanges mounted on each of said arms means and extending toward each other, each of the stringer tapes being movable between said spaced side flanges when the rows of coupling elements pass through said Y-shaped guide channel, and spring means acting between said base and said pair of arm means to normally bias said arm means in a direction to cause said side flanges to complete said Y-shaped guide channel.

6. An apparatus according to claim 5, each of said arm means comprising a pair of spaced arms from which said side flanges project, respectively.

7. An apparatus according to claim 1, said first guide means comprising a pair of spaced plates and a central neck disposed between and interconnecting said spaced plates, said first flange means comprising a pair of spaced first side flanges projecting from said plates, respectively, toward each other and located on each side of said central neck, said first side flanges terminating short of said joint passage whereby said spaced plates include a pair of side-flange-free end portions, respectively, located at said joint passage, said second guide means comprising a pair of arm means pivotally mounted on said base and located one on each side of said spaced plates, said second flange means comprising a pair of spaced second side flanges mounted on each of said arm means and extending toward each other, each of the stringer tapes being movable between said first side flanges and between said second side flanges when the rows of coupling elements pass through said Y-shaped guide channel, and spring means acting between said base and said pair of arm means to normally bias said arm means in a direction to cause said second side flanges to engage said side-flange-free end portions to complete said Y-shaped guide channel.

8. An apparatus according to claim 1, said second guide means comprising slide means slidably mounted on said base, said second flange means comprising a pair of spaced side flanges mounted on said slide means and extending toward each other, one of the stringer tapes being movable between said spaced side flanges when the rows of coupling elements pass through said Y-shaped guide channel, and spring means acting between said base and said slide means to normally bias said slide means in a direction to cause said side flanges to complete said Y-shaped guide channel.

9. An apparatus according to claim 1, said first guide means comprising a pair of spaced plates and a central neck disposed between and interconnecting said spaced plates, said first flange means comprising a pair of spaced first side flanges projecting from said plates, respectively, toward each other and located on each side of said central neck, one of said first side flanges terminating short of said joint passage whereby said plates include a pair of end portions free of side flanges at their one side and located at said joint passage, said second guide means comprising slide means slidably mounted on said base, said second flange means comprising a pair of spaced second side flanges mounted on said slide means and extending toward each other, one of the stringer tapes being movable between said first side flanges and between said second side flanges when the rows of coupling elements pass through said Y-shaped guide channel, and spring means acting between said base and said slide means to normally bias said slide means in a direction to cause said second side flanges to engage said end portions at said one side for completing said Y-shaped guide channel.

10. An apparatus according to claim 1, including means on said base for displacing said second guide means away from said first guide means.

11. An apparatus according to claim 10, said displacing means comprising an eccentric cam angularly movably mounted on said base and having a cam surface engageable with said second guide means, and a lever fixed to said eccentric cam.

12. An apparatus according to claim 10, said second guide means comprising a pair of arm means pivotally mounted on said base and located one on each side of said first guide means, said second flange means comprising a pair of spaced side flanges mounted on each of said arm means and extending toward each other, each of the stringer tapes being movable between said spaced side flanges when the rows of coupling elements pass through said Y-shaped guide channel, and spring means acting between said base and said pair of arm means to normally bias said arm means in a direction to cause said side flanges to complete said Y-shaped guide channel, said displacing means comprising a pair of eccentric cams angularly movably mounted on said base and having a pair of cam surfaces, respectively, engageable with said pair of arm means against the bias of said spring means, and a pair of levers fixed respectively to said eccentric cams.

13. An apparatus according to claim 10, said second guide means comprising slide means slidably mounted on said base, said second flange means comprising a pair of spaced side flanges mounted on said slide means and extending toward each other, one of the stringer tapes being movable between said spaced side flanges when the rows of coupling elements pass through said Y-shaped guide channel, and spring means acting between said base and said slide means to normally bias said slide means in a direction to cause said side flanges to complete said Y-shaped guide channel, said displacing means comprising an eccentric cam angularly movably mounted on said base and having a cam surface engageable with said slide means against the bias of said spring means, and a lever fixed to said eccentric cam.

14. An apparatus according to claim 1, including a pair of roller means rotatably mounted on said base for supporting thereon the stringer tapes, respectively, before they enter said Y-shaped guide channel respectively through said pair of branched passages.

15. An apparatus according to claim 1, said second guide means including a pair of spaced side flanges extending toward each other, one of the stringer tapes being movable between said spaced side flanges when the rows of coupling elements pass through said Y-shaped guide channel, and spring means acting between said base and said second guide means to normally hold said side flanges in a position where they complete said Y-shaped guide channel.

* * * * *